US008061338B1

(12) United States Patent
Gibboney et al.

(10) Patent No.: US 8,061,338 B1
(45) Date of Patent: Nov. 22, 2011

(54) IGNITION COIL TO SPARK PLUG MATING APPARATUS

(75) Inventors: Jim Gibboney, Livonia, MI (US); Francis Martin Donahue, Ypsilanti, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 12/851,142

(22) Filed: Aug. 5, 2010

(51) Int. Cl.
*H01R 13/436* (2006.01)
*H01T 13/04* (2006.01)
*H01T 13/56* (2006.01)

(52) U.S. Cl. ..... 123/635; 123/634; 123/169 PA; 439/127; 439/817

(58) Field of Classification Search ..... 123/143 C, 123/169 PA, 169 PH, 634, 635; 439/127, 439/817
See application file for complete search history.

(56) References Cited

U.S. PATENT DOCUMENTS

| | | | | |
|---|---|---|---|---|
| 1,930,639 | A | 10/1933 | Berthold | |
| 2,819,428 | A | 1/1958 | Bowlus et al. | |
| 4,073,565 | A | 2/1978 | Raymond | |
| 4,387,948 | A | 6/1983 | Johnson | |
| RE31,472 | E | 12/1983 | Keller | |
| 5,618,193 | A * | 4/1997 | Nakajima et al. | 439/125 |
| 5,767,758 | A * | 6/1998 | Sakamaki | 336/84 M |
| 5,875,767 | A * | 3/1999 | Bock et al. | 123/635 |
| 6,087,918 | A * | 7/2000 | Henry et al. | 336/96 |
| 6,193,528 | B1 * | 2/2001 | Rea et al. | 439/127 |
| 6,280,210 | B1 | 8/2001 | Sikora et al. | |
| 6,358,071 | B1 * | 3/2002 | Moga | 439/125 |
| 6,427,674 | B1 * | 8/2002 | Wylin | 123/634 |
| 6,467,447 | B1 | 10/2002 | Holmes et al. | |
| 6,609,508 | B2 * | 8/2003 | Sexton | 123/634 |
| 7,234,454 | B2 * | 6/2007 | Tauchi et al. | 123/634 |
| 7,455,536 | B2 * | 11/2008 | Virchow | 439/125 |
| 2003/0070665 | A1 * | 4/2003 | Paul et al. | 123/635 |
| 2003/0127080 | A1 * | 7/2003 | Sexton | 123/634 |
| 2005/0179183 | A1 | 8/2005 | Paul et al. | |

* cited by examiner

*Primary Examiner* — Erick Solis
(74) *Attorney, Agent, or Firm* — Julia Voutyras; Alleman Hall McCoy Russell & Tuttle LLP

(57) ABSTRACT

A retaining apparatus is provided for mating an ignition coil to a spark plug.

20 Claims, 3 Drawing Sheets

IGNITION COIL TO SPARK PLUG MATING APPARATUS

BACKGROUND AND SUMMARY

Some vehicle engines implement an ignition system where a separate ignition coil is connected to each spark plug without the use of a distributor and spark plug wires in what is commonly referred to as a coil-on-plug ignition system. The coil-on-plug ignition system provides various benefits relative to other types of ignition systems. For example, the coil-on-plug ignition system allows each ignition coil a longer time to accumulate a charge between sparks relative to an ignition system where a single ignition coil provides charge to a plurality of spark plugs. Accordingly, the coil-on-plug ignition system provides a higher energy spark relative to other such systems.

FIG. 1 shows one example of an ignition system 100 having a coil-on-plug configuration for one cylinder of an engine. The ignition system 100 includes an ignition coil 102. A camshaft cover 104 forms a passage 106 where the ignition coil 102 is inserted to gain access through the camshaft cover 104 to a spark plug (not shown). The ignition coil 102 connects to a terminal of the spark plug in order to provide an electrical charge to the spark plug.

The ignition coil 102 is bolted to the camshaft cover 104 to secure the ignition coil in the passage 106 so that the ignition coil 102 remains connected to the spark plug. In particular, the ignition coil 102 comprises a mounting arm 108 that extends away from the passage 106 and protrudes over the camshaft cover 104. The mounting arm 108 comprises a threaded portion 110 for receiving a fastener (e.g., a bolt) 112. Correspondingly, the camshaft cover comprises a threaded portion 114 to receive the fastener 112. Further, the camshaft cover 104 comprises a mounting boss 116 for aligning the mounting arm 108 with the camshaft cover 104 so that the threaded portion 110 of the mounting arm 108 aligns with the threaded portion 114 of the camshaft cover 104 so that that fastener 112 can be screwed into the threaded portion 110 and further into threaded portion 114 to secure the ignition coil 102 to the camshaft cover 104.

However, the inventors have recognized several potential issues with such a configuration. For example, by bolting the ignition coil to the camshaft cover, the tolerances of each component stack up so that variations in dimensions and tolerances of the components create additional interference or reduced clearance. This in turn results in component deflection upon assembly and/or increased wear that reduces the operational life of the components. Moreover, noise, vibration, harshness (NVH) characteristics of the camshaft cover are transferred to the ignition coil resulting in reduced connection stability and/or increased wear.

In one example, the above mentioned issues may be addressed by an ignition system comprising: a spark plug comprising a spark plug terminal; an ignition coil comprising a barbed terminal; a housing covering the spark plug, the housing forming a passage for the ignition coil to access the spark plug; and a retaining apparatus comprising: a first spring clip to retain the barbed terminal; and a second spring clip to retain the spark plug terminal to mate the ignition coil to the spark plug. In one particular example, this enables the ignition coil not to be mounted to the camshaft cover, if desired.

By mating the ignition coil to the spark plug with the retaining apparatus instead of mounting the ignition coil to the camshaft cover, for example, the stack up of tolerances of the ignition coil can be reduced. In this way, the connection between the ignition coil and the spark plug can be made more stable and consistent and the operating life of the components can be increased due to reduced wear. This configuration may be especially beneficial in engines that utilize floating composite camshaft covers that are isolated from the cylinder head by an insolating layer, because the camshaft cover has a greater tendency to change position relative to the position of the spark plug as a result of NVH.

Moreover, since the ignition coil is not mounted to the camshaft cover, various mounting features of the ignition coil and the camshaft cover can be eliminated, if desired. In particular, the mounting arm and the threaded portion can be eliminated from the ignition coil and the mounting boss and the threaded portion can be eliminated from the camshaft cover. In addition, the fastener can be eliminated from the ignition system. In this way, the ignition system can be made less complex resulting in a reduction in production costs.

It will be understood that the summary above is provided to introduce in simplified form a selection of concepts that are further described in the detailed description, which follows. It is not meant to identify key or essential features of the claimed subject matter, the scope of which is defined by the claims that follow the detailed description. Further, the claimed subject matter is not limited to implementations that solve any disadvantages noted above or in any part of this disclosure.

BRIEF DESCRIPTION OF THE DRAWINGS

The subject matter of the present disclosure will be better understood from reading the following detailed description of non-limiting embodiments, with reference to the attached drawings, wherein.

DETAILED DESCRIPTION

The subject matter of the present disclosure is now described by way of example and with reference to certain illustrated embodiments. Components that may be substantially the same in two or more embodiments are identified coordinately and are described with minimal repetition. It will be noted, however, that components identified coordinately in different embodiments of the present disclosure may be at least partly different. It will be further noted that the drawings included in this disclosure are schematic. Views of the illustrated embodiments are generally not drawn to scale; aspect ratios, feature size, and numbers of features may be purposely distorted to make selected features or relationships easier to see.

Figure 1:
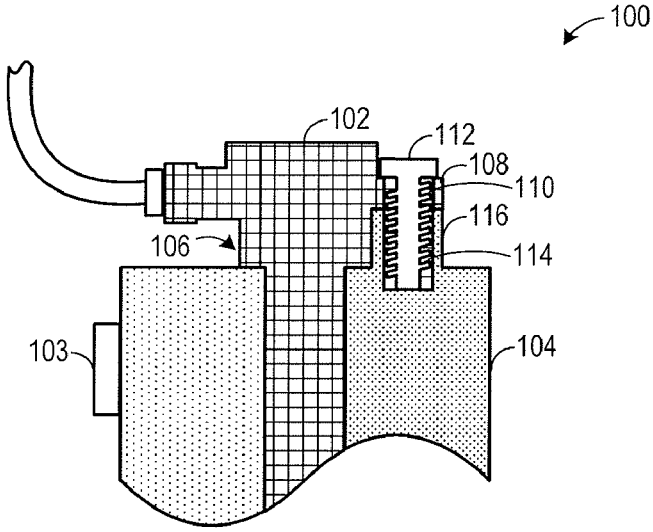
PRIOR ART FIG. 1
FIG. 1 is a schematic diagram of an example prior art ignition system.
Figure 2:
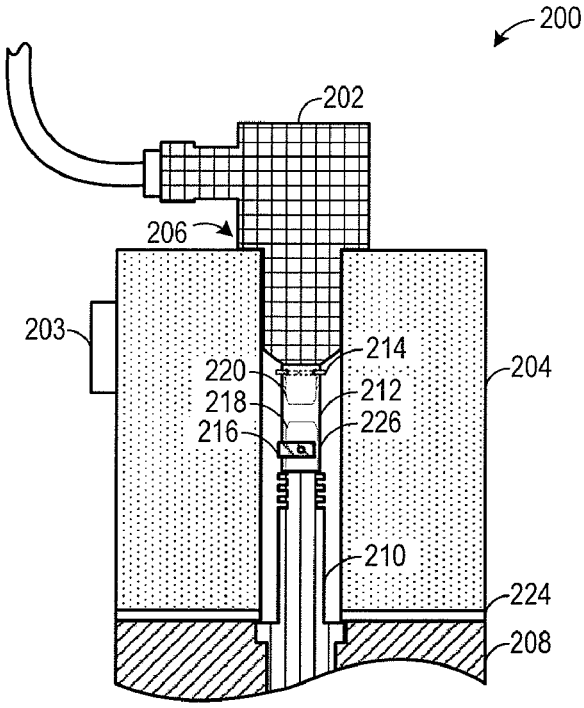
FIG. 2 is a schematic diagram of an example embodiment of an ignition system of the present disclosure.

FIG. 2 schematically shows an embodiment of an ignition system 200 where an ignition coil 202 is connected to a spark plug 210 by a retaining apparatus 212. The retaining apparatus 212 provides a rigid connection that secures the ignition coil in place so that the ignition coil does mount to any other engine component to be securely connected to the spark plug 210.

The spark plug 210 is positioned in a cylinder head 208 corresponding to one cylinder (not shown) of a multi-cylinder engine. The spark plug 210 creates a spark in the corresponding cylinder to initiate combustion. The spark plug 210 comprises a spark plug terminal 218 that electrically connects with a barbed terminal 220 of the ignition coil 202 via the retaining apparatus 212 to receive an electrical charge that causes the spark plug to spark.

A housing 204 is positioned above the cylinder head 208. The housing 204 may form an upper surface of the engine. In some embodiments, the housing 204 comprises a cover for a camshaft 203 positioned above the cylinder head 208. In some embodiments, the housing 204 comprises a portion of the cylinder head 208. In some embodiments, the housing 204 comprises an ignition coil rail that is coupled to the cylinder head to align a plurality of ignition coils with a plurality of corresponding spark plugs. The housing 204 forms a passage 206 for the ignition coil 202 to access the spark plug 210. The passage 206 allows for the ignition coil 202 to be inserted through the housing 204 to connect to the spark plug 210 without removal of the housing 204. The configuration permits easy insertion and removal of the ignition coil 202 for service maintenance and/or replacement.

The ignition coil 202 may be a high-voltage ignition coil that connects to a corresponding spark plug without spark plug wires in what is referred to as a coil-on-plug configuration. The ignition coil 202 comprises a barbed terminal 220 that cooperates with the retaining apparatus 212 and the spark plug terminal 218 to thereby mate the ignition coil 202 with the spark plug 210.

Figure 3:
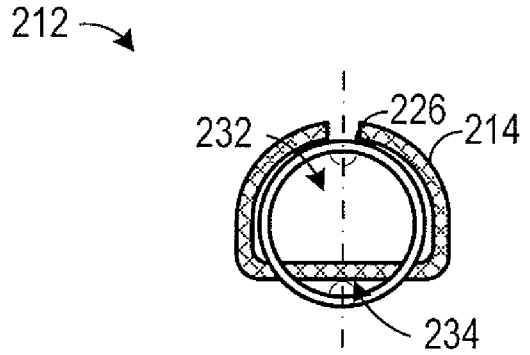
FIG. 3 is a top view of a retaining apparatus.

The retaining apparatus 212 comprises a body 226 that is rigid and forms a cylindrical shaft 232 (shown in FIG. 3). In some embodiments, the body 226 may comprise stamped metal, such as brass or steel. Such material provides suitable stability characteristics to maintain a connection between the ignition coil 202 and the spark plug 210. The retaining apparatus 212 comprises a first spring clip 214 that is inserted near a first end 228 (shown in FIG. 4) of the body 226. When inserted in the body 226, a portion 234 (shown in FIG. 3) of the first spring clip 214 protrudes inside the shaft 232 formed by the body 226 to reduce an interior diameter of the shaft 232 in some areas. The barbed terminal 220 is inserted into the first end 228 of the rigid body 226 to an extent that barbs 238 (shown in FIG. 6) on the barbed terminal 220 move beyond the first spring clip 214. The first spring clip 214 and the barbs 238 of the barbed terminal 220 cooperate to retain the barbed terminal 220 in the retaining apparatus 212. In particular, when a pull-out force is applied to the barbed terminal 220, it causes the barbs 238 to flare outward and catch on the first spring clip 214 to retain the barbed terminal 220 in the retaining apparatus 212. In some embodiments, the first spring clip 214 may comprise a D-ring type spring clip or a C type clip.

The retaining apparatus 212 comprises a second spring clip 216 that is different from the first spring clip 214. The second spring clip 216 wraps around a circumferential portion of an exterior of the body 226 near a second end 230 of the body 226. The second spring clip 216 comprises a plurality of dimples or inward-facing protuberances 236 (shown in FIG. 5) that protrude inside the shaft 232 formed by the body 226. In particular, the body 226 forms a plurality of holes sized to accommodate and retain the protuberances 236. The second spring clip 216 is sized so that spring force is applied to the body 226 to retain the protuberances 236 in the holes formed by the body 226. The holes and correspondingly the protuberances 236 are positioned in the body 226 to align with a neck of the spark plug terminal 218 when it is inserted in the body 226. The second spring clip 216 can be inserted around the exterior of the body 226 after the spark plug terminal 218 has been inserted into the shaft 232 to retain the spark plug terminal 218 in the retaining apparatus 212 to thereby mate the ignition coil 202 to the spark plug 210. In some embodiments, the second spring clip 216 may comprise a D-ring type spring clip or a C type clip.

The rigid body of the retaining apparatus 212 facilitates stable positioning and connectivity between the ignition coil 202 and the spark plug 210 so that the ignition coil 202 does not need to be secured to other structures to remain in place and. As such, the ignition coil 202 does not comprise a mounting arm for fastening the ignition coil 202 to the housing 204. By eliminating such features, a size of the ignition coil 202 can be reduced, the shape of the ignition coil 202 can be made less complex, and production costs of the ignition coil 202 can be reduced.

Furthermore, since the ignition coil does not need to be secured to the housing, fasteners and/or corresponding fastener-securing structure can be eliminated from the assembly of the ignition system 200. For example, the ignition coil 202 does not comprise a threaded portion for receiving a fastener to mount the ignition coil to the housing 204. Correspondingly, the housing 204 does not comprise a mounting boss for receiving an ignition coil mounting arm. Moreover, the housing 204 does not comprise a threaded portion for receiving a fastener to mount the ignition coil to the housing. By eliminating fasteners and corresponding fastener-securing structure, the ignition coil 202 and the housing 204 can be made less complex. Further, production costs can be reduced by eliminating fasteners and threaded inserts or from the ignition system. Further still, assembly cycle time can be reduced since fasteners do not need to be installed (e.g., screwed into threads) in the ignition system.

In some embodiments of the ignition system 200, the housing 204 forms a floating composite camshaft cover for camshaft 203 that is isolated from the cylinder head 208 by an insolating layer 224. The insolating layer 224 reduces noise, vibration, harshness (NVH) affects by substantially decoupling the camshaft cover from the cylinder head. As such, under some conditions, the camshaft cover changes position relative to the cylinder head. Since the ignition coil is mated directly to the spark plug via the retaining apparatus instead of being coupled to the camshaft cover, the ignition coil can remain stably connected to the spark plug even when movement of the camshaft cover occurs.

In some embodiments, the ignition system 200 may comprise various alignment features to align the ignition coil 202, the retaining apparatus 212, and/or the spark plug 210. The alignment features may be formed on any or all of the ignition coil 202, the retaining apparatus 212, and/or the spark plug 210. Further, in some embodiments, the housing 204 may comprise an alignment feature.

Figure 4:
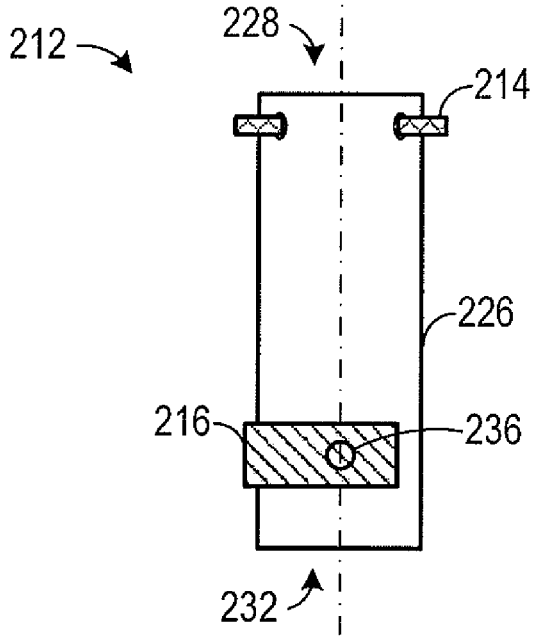
FIG. 4 is a front view of the retaining apparatus of FIG. 2.
Figure 5:
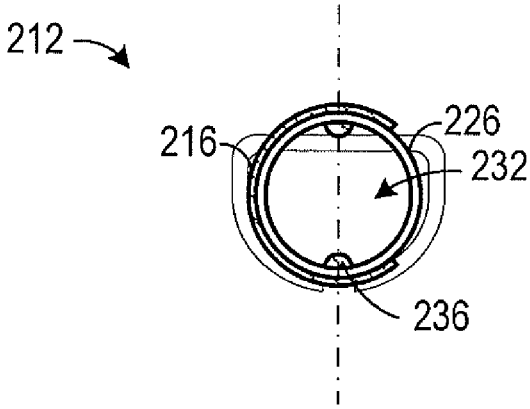
FIG. 5 is a bottom view of the retaining apparatus of FIG. 2.

FIGS. 3-5 show different views of the retaining apparatus 212. FIG. 3 shows a top view of the retaining apparatus 212. FIG. 4 shows a front view of the retaining apparatus 212. FIG. 5 shows a bottom view of the retaining apparatus 212. The retaining device is herein described collectively referencing FIGS. 3-5.

The retaining apparatus 212 comprises a cylindrical body 226. The cylindrical body 226 has a diameter suitably large enough to accommodate the spark plug terminal 218 and the barbed terminal 220 of the ignition coil 202. Further, the diameter is small enough to reduce NVH effects created from vibration of the terminals against the body 226. The cylindrical body 226 may be made of stamped metal. By using stamped metal features can be easily formed in the body to accommodate the spring clips and the retaining apparatus can be produced in a quick, scalable, and inexpensive manner. The stamped metal used to form the body 226 may include brass or steel. Brass and steel have suitable material strength characteristics for stabilizing the ignition coil in a fixed position relative to the spark plug. Further, brass and steel have suitable conductivity characteristics to create an electrical connection between the barbed terminal of the ignition coil and the spark plug terminal. It will be appreciated that other metals having suitable material strength and conductivity characteristics may be used to form the body of the retaining apparatus.

A first spring clip 214 couples near the first end 228 of the cylindrical body 226 to retain the barbed terminal 220 of the ignition coil 202 in the retaining apparatus 212. In particular, the first spring clip 214 is inserted into the body 226 perpendicular to the shaft 232 through openings formed in the body 226 that are sized to accommodate portions 234 of the first spring clip 214 that protrude into the shaft 232. The protruding portions 234 reduce the interior diameter in some areas of the shaft 232 to create a choke or retention point to retain the barbed terminal 220 of the ignition coil 202. The protruding portions 234 cooperate with spring force applied by the first spring clip 214 against the body 226 to couple the first spring clip 214 to the body 226. In some embodiments, the first spring clip 214 may comprise a D-ring type spring clip or a C type spring clip. In some embodiments, the first spring clip 214 may be permanently or semi-permanently coupled to the body 226.

A second spring clip 216 couples near the second end 230 of the cylindrical body 226 to retain the spark plug terminal 218 in the retaining apparatus 212. In particular, the second spring clip 216 comprises inward-facing protuberances 236 and the body 226 forms opening sized to accommodate the protuberances 236. The second spring clip 214 wraps around a portion of the exterior of the body 226 so that the protuberances 236 align with the openings in the body 226 so that the protuberances 236 protrude into the shaft 232. The protuberances 236 reduce the interior diameter in some areas of the shaft 232 to create a choke or retention point to retain the spark plug terminal 218. The protuberances 236 cooperate with spring force applied by the second spring clip 216 against the body 226 to couple the second spring clip 214 to the body 226. In some embodiments, the second spring clip 216 may comprise a D-ring type spring clip or a C type spring clip.

Figure 6:
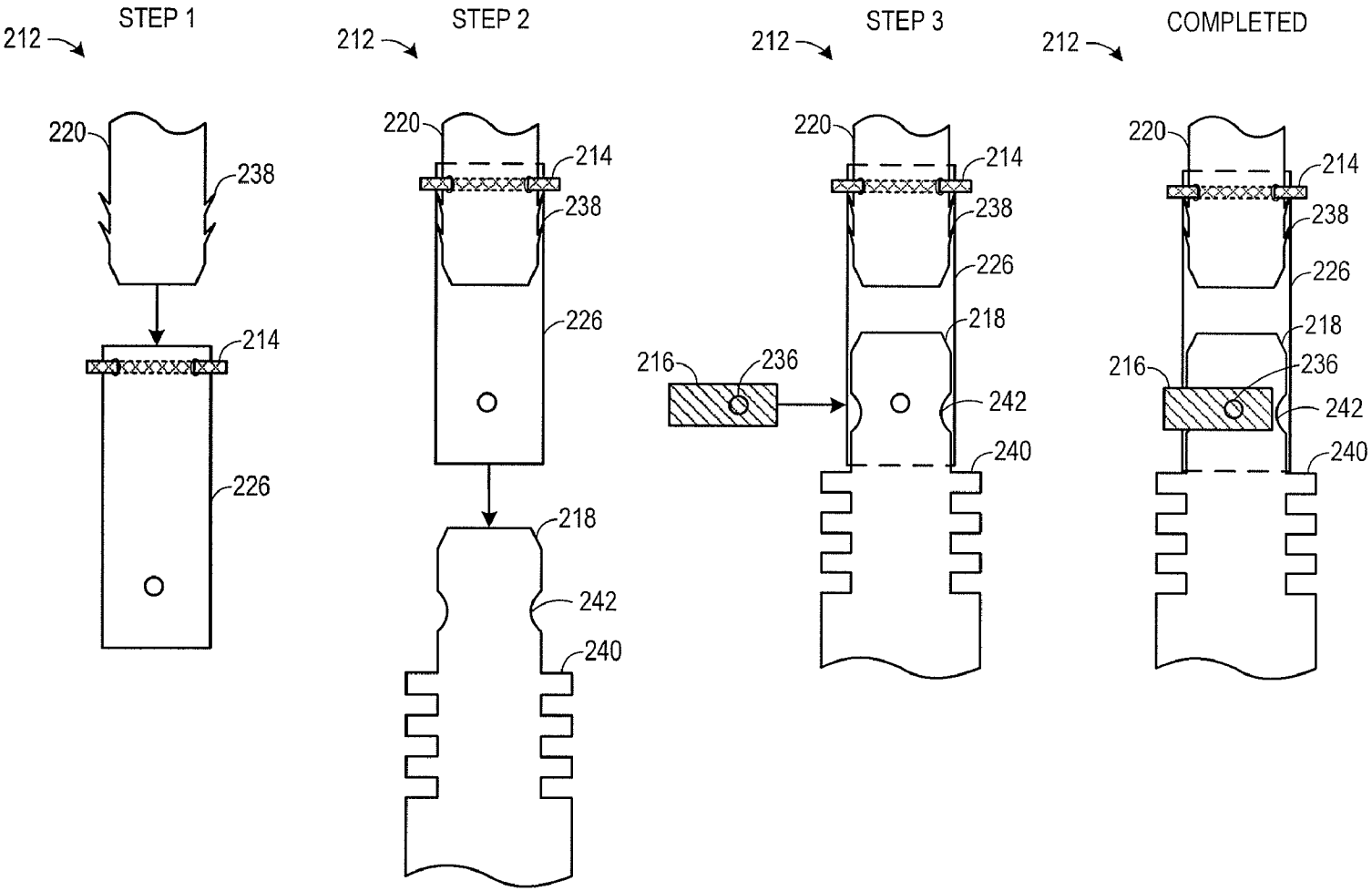
FIG. 6 shows a process for mating an ignition coil to a spark plug via a retaining apparatus.

FIG. 6 shows a process for mating the ignition coil 202 to the spark plug 210 via the retaining apparatus 212. At step 1, the first spring clip 214 is inserted into the body 226 of the retaining apparatus 212 and the second spring clip is removed from the body. In some cases, the first spring clip 214 may be semi-permanently or permanently installed in the body 226. The barbed terminal 220 is inserted into the first end 228 of the shaft 232 till the barbs 238 of the barbed terminal 220 travel beyond the retention point of the first spring clip 214. The barbs 238 are angled in a direction to allow insertion of the barbed terminal 220 into the body.

At step 2, the barbed terminal 220 is retained in the body 226 by the first spring clip 214. In particular, the barbs 238 of the barbed terminal 220 are angled so as to be pushed outward away from the barbed terminal and against the protruding portions 234 of the first spring clip when a pull-out force is applied to the barbed terminal 220. The second spring clip 216 is wrapped around an exterior portion of the body 226 until the protuberances 236 of the second spring clip 216 align with the openings in the body and protrude through the openings into the shaft 232.

At step 3, the barbed terminal 220 is retained at the first end 228 of the body 226 and the second spring clip 216 has been wrapped around the exterior potion of the body 226 such that the protuberances 236 have been inserted into holes in the body. The spark plug terminal 218 is inserted into the second end 230 of the shaft 232 till the body 226 buts up against insulator ribs 240 of the spark plug and a neck 242 of the spark plug terminal 218 has moved beyond the protuberances 236 of the second spring clip 216. The protuberances 236 protrude suitably far enough into the shaft 232 to engage the neck 242 of the spark plug terminal 218 and retain the spark plug terminal 218 in the retaining apparatus 212 to thereby mate the ignition coil 202 to the spark plug 210.

The second spring clip 216 may have material strength characteristics different from the first spring clip 214 to accommodate different operational parameters. For example, since the spark plug 210 may be removed for service maintenance and/or replacement more frequently than the ignition coil 202, the second spring clip 216 may have a pull-off force that is smaller than a pull-off force of the first spring clip 214. More particularly, a first pull-off force of the second spring clip 216 from the spark plug terminal 218 and/or the body 226 may not exceed a 1:2 ratio relative to a second pull-off force of the barbed terminal 220 from the first spring clip 216. In one particular example, the pull-off force of the barbed terminal from the first spring clip is in a range of 40-50 pounds. Such a configuration allows for easier removal of the spark plug side spring clip while providing added robustness to the ignition coil side spring clip so as to provide suitable robustness to secure the ignition coil to the spark plug.

Furthermore, the second spring clip may have an insertion force that is different from an insertion force of the first spring clip to accommodate different operational parameters. For example the insertion force of the second spring clip on to the spark plug terminal may be 15 pounds to meet manufacturing assembly guidelines. The first spring clip may have an insertion force that is the same or larger than 15 pounds to accommodate the larger pull-off force characteristic of the first spring clip.

Finally, it will be understood that the articles, systems and methods described herein are exemplary in nature, and that these specific embodiments or examples are not to be considered in a limiting sense, because numerous variations are contemplated. Accordingly, the present disclosure includes all novel and non-obvious combinations and sub-combinations of the various systems and methods disclosed herein, as well as any and all equivalents thereof.

The invention claimed is:

1. An ignition system comprising:
- a spark plug comprising a spark plug terminal;
- an ignition coil comprising a barbed terminal;
- a housing covering the spark plug, the housing forming a passage for the ignition coil to access the spark plug; and
- a retaining apparatus comprising:
  - a first spring clip to retain the barbed terminal; and
  - a second spring clip to retain the spark plug terminal to mate the ignition coil to the spark plug.

2. The system of claim 1, wherein the retaining apparatus comprises a cylindrical body.

3. The system of claim 2, wherein the cylindrical body is made of a stamped metal.

4. The ignition system of claim 3, wherein the stamped metal includes brass or steel.

5. The system of claim 1, wherein a first pull-off force of the second spring clip from the spark plug terminal does not exceed a 1:2 ratio relative to a second pull-off force of the barbed terminal from the first spring clip.

6. The system of claim 1, wherein a pull-off force of the barbed terminal from the first spring clip is in a range of 40-50 pounds.

7. The system of claim 1, wherein an insertion force of the second spring clip on to the spark plug terminal is 15 pounds.

8. The system of claim 1, wherein the ignition coil does not comprise a mounting arm for fastening the ignition coil to the housing.

9. The system of claim 1, wherein the ignition coil does not comprise a threaded portion for receiving a fastener to mount the ignition coil to the housing.

10. The system of claim 1, wherein the housing does not comprise a mounting boss for receiving an ignition coil mounting arm.

11. The system of claim 1, wherein the housing does not comprise a threaded portion for receiving a fastener to mount the ignition coil to the housing.

12. An ignition assembly comprising:

a spark plug comprising a spark plug terminal;

an ignition coil comprising a barbed terminal; and a retaining apparatus comprising a first spring clip to retain the barbed terminal and a second spring clip to retain the spark plug terminal to thereby mate the ignition coil to the spark plug.

13. The assembly of claim 12, wherein the retaining apparatus comprises a cylindrical body made of stamped brass or steel.

14. The assembly of claim 12, wherein a first pull-off force of the second spring clip from the spark plug terminal does not exceed a 1:2 ratio relative to a second pull-off force of the barbed terminal from the first spring clip.

15. The assembly of claim 12, wherein a pull-off force of the barbed terminal from the first spring clip is in a range of 40-50 pounds.

16. The assembly of claim 12, wherein an insertion force of the second spring clip on to the spark plug terminal is 15 pounds.

17. The assembly of claim 12, wherein the ignition coil does not mount to a housing.

18. A retaining apparatus comprising:

a cylindrical body;

a first spring clip coupled to the cylindrical body to retain a barbed terminal of an ignition coil; and a second spring clip coupled to the cylindrical body to retain a spark plug terminal of a spark plug to thereby mate the ignition coil to the spark plug.

19. The apparatus of claim 18, wherein a first pull-off force of the second spring clip from the spark plug terminal relative to a second pull-off force of the barbed terminal from the first spring clip does not exceed a 1:2 ratio.

20. The apparatus of claim 18, wherein a pull-off force of the barbed terminal from the first spring clip is in a range of 40-50 pounds, and an insertion force of the second spring clip on to the spark plug terminal is 15 pounds.

* * * * *